US006513675B1

(12) United States Patent
Brown et al.

(10) Patent No.: US 6,513,675 B1
(45) Date of Patent: Feb. 4, 2003

(54) FOOD CONTAINER WITH RIGID BASE PLATE

(75) Inventors: Dean R. Brown, La Habra, CA (US); John E. Bussey, Anaheim, CA (US)

(73) Assignee: Paul Winkler Plastics Corp., Buena Park, CA (US)

( * ) Notice: Subject to any disclaimer, the term of this patent is extended or adjusted under 35 U.S.C. 154(b) by 57 days.

(21) Appl. No.: 09/584,600

(22) Filed: May 31, 2000

(51) Int. Cl.[7] ..... B65D 41/00

(52) U.S. Cl. ..... 220/608; 220/783; 229/406; 229/407

(58) Field of Search ..... 220/608, 509, 220/516, 519, DIG. 12, 783; 229/406, 407

(56) References Cited

U.S. PATENT DOCUMENTS

| | | | | |
|---|---|---|---|---|
| 1,743,980 A | | 1/1930 | Samson | |
| 3,556,338 A | | 1/1971 | Wilkinson et al. | 220/60 |
| 3,563,445 A | * | 2/1971 | Clayton | 229/407 |
| 3,592,349 A | | 7/1971 | Baugh | 215/41 |
| 3,682,365 A | | 8/1972 | Reifers et al. | 229/2.5 |
| 3,718,274 A | | 2/1973 | Reifers et al. | 229/2.5 |
| 4,202,464 A | | 5/1980 | Mohs et al. | 220/339 |
| 4,256,240 A | | 3/1981 | Woinarski | 220/306 |
| 4,290,248 A | | 9/1981 | Kemerer et al. | 52/309.16 |
| 4,334,631 A | | 6/1982 | Ballester | 220/306 |
| 4,373,636 A | | 2/1983 | Hoffman | 206/551 |
| 4,408,698 A | | 10/1983 | Ballester | 220/306 |
| 4,444,332 A | | 4/1984 | Widén et al. | 220/306 |
| 4,570,818 A | | 2/1986 | Borst et al. | 220/339 |
| 4,574,974 A | | 3/1986 | von Holdt | 220/306 |
| 4,706,839 A | | 11/1987 | Spence | 220/315 |
| 4,719,087 A | | 1/1988 | Hanaway | 422/102 |
| 4,741,452 A | * | 5/1988 | Holzkopf | 220/783 |
| 4,834,237 A | | 5/1989 | Henke et al. | 206/373 |
| 4,883,195 A | * | 11/1989 | Ott et al. | 229/406 X |
| 4,886,184 A | | 12/1989 | Chamourian | 220/306 |
| 4,933,216 A | | 6/1990 | Filbert et al. | 428/34.1 |
| 5,273,174 A | | 12/1993 | Fisher | 220/4.21 |
| 5,287,959 A | * | 2/1994 | Hansen et al. | 220/783 X |
| 5,368,178 A | | 11/1994 | Towns et al. | 215/317 |
| 5,405,009 A | | 4/1995 | Hackenbracht | 206/470 |
| 5,507,429 A | | 4/1996 | Arlin | 229/102 |
| 5,540,342 A | | 7/1996 | Rathbun | 215/225 |
| 5,607,709 A | * | 3/1997 | Fritz et al. | 220/608 X |
| 5,762,221 A | | 6/1998 | Tobias et al. | 215/381 |
| 5,829,595 A | | 11/1998 | Brown et al. | 206/600 |
| 5,866,181 A | | 2/1999 | Hill | 426/107 |
| 5,866,183 A | | 2/1999 | Small | 426/383 |
| 5,897,015 A | | 4/1999 | Sheahan | 220/281 |
| 6,149,053 A | * | 11/2000 | Chatterton et al. | 220/608 X |

* cited by examiner

*Primary Examiner*—Steven Pollard
(74) *Attorney, Agent, or Firm*—Faegre & Benson LLP

(57) ABSTRACT

A food container with a rigid base plate formed of a generally planar polymer sheet to have a plurality of stiffening projections extending out of the plane of the sheet, the stiffening projections including a first serpentine projection formed in a segmented, non-linear path and a second, shallower serpentine projection also formed in a segmented non-linear path, a peripheral gutter and a centrally located oval shaped projection free of interconnection with the first and second serpentine projections, with lands between the stiffening projections forming a generally planar top surface of the base plate. The food container also has a cover of polymer material and the cover and base plate are designed to nest for pre-use storage and stack when assembled in use.

36 Claims, 7 Drawing Sheets

FOOD CONTAINER WITH RIGID BASE PLATE

TECHNICAL FIELD

This invention relates to the field of containers for food items, particularly baked goods, and more particularly, to cakes and the like that need to be supported on a relatively large area, flat carrier for storage and presentation.

BACKGROUND OF THE INVENTION

In the past, cakes, particularly sheet cakes have been stored and presented on a cardboard bottom plate, and stored and carried in a cardboard or paperboard box. Alternatively, flat plastic plates, possibly with a raised peripheral lip have been used, along with a clear plastic cover. Such prior art attempts to provide a bakery container have suffered from various shortcomings. The card and paperboard containers and base plates have been awkward to use, the container obscures the contents, and the paperboard and flat plastic base plates have suffered from being too flexible, putting the contents at risk during handling and transport. In addition, uncoated paper products are absorbent to fats often found in such bakery products, which may result in a stained, unappetizing appearance.

SUMMARY OF THE INVENTION

The present invention overcomes shortcomings of the prior art by providing a bakery container with a rigid base plate having a planar surface with stiffening projections that extend out of the planar surface. The stiffening projections include a peripheral pattern and a centrally located projection unconnected with the peripheral pattern. The container optionally has a cover that mates with the base plate. As further options, the cover may be made of polymer, and is preferably, although not necessarily clear. In addition, the base plate and cover are designed to both nest when empty, and stack when assembled, saving storage space in the bakery. In a preferred embodiment, a peripheral gutter and reduced depth projections in a portion of the base plate near the periphery cooperate with a raised peripheral region in the top of the cover to maintain vertical alignment when assembled base plates and covers are stacked.

DETAILED DESCRIPTION OF THE INVENTION

Figure 1:
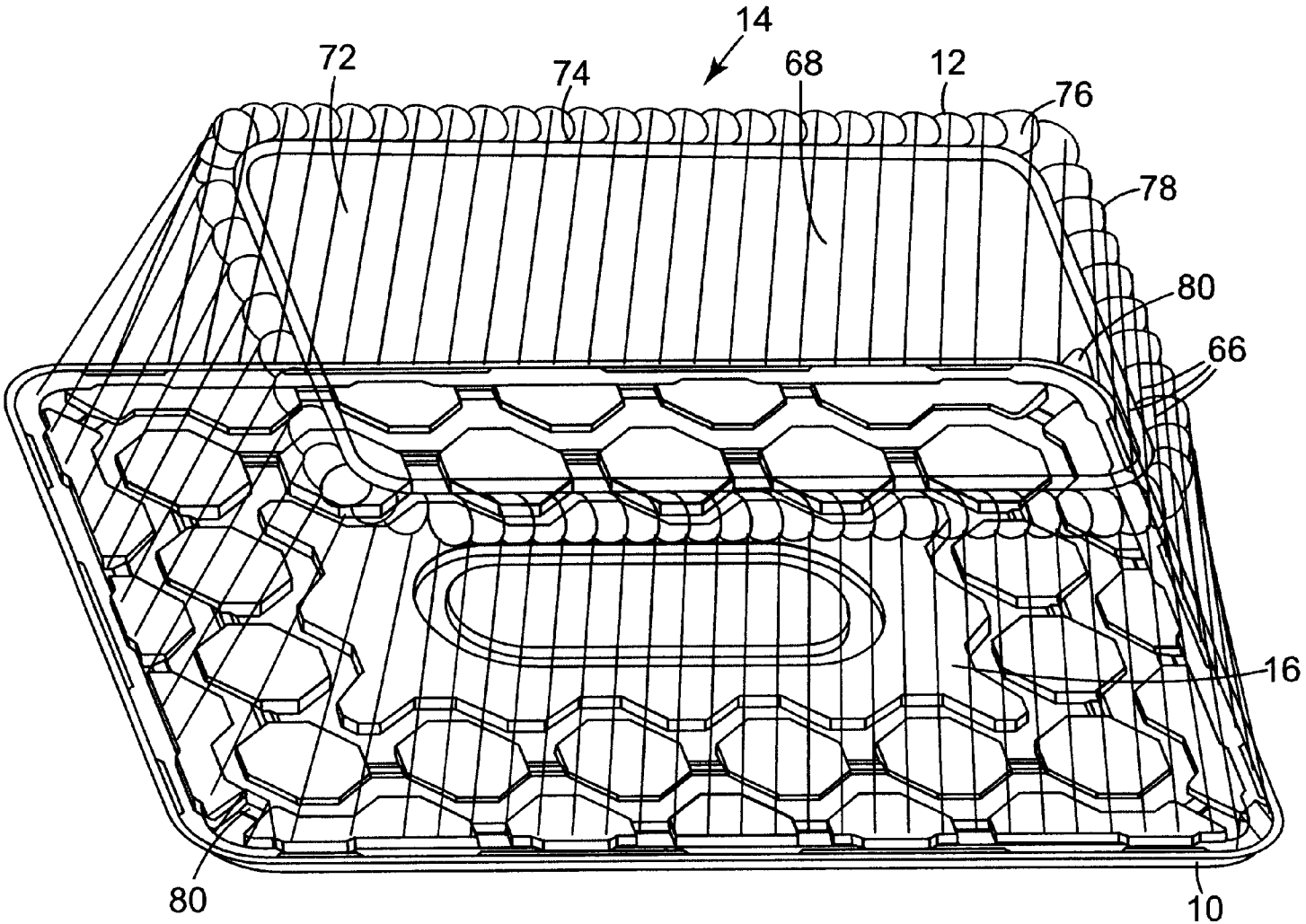
FIG. 1 is a perspective view of the base plate and cover bakery container of the present invention.
Figure 2:
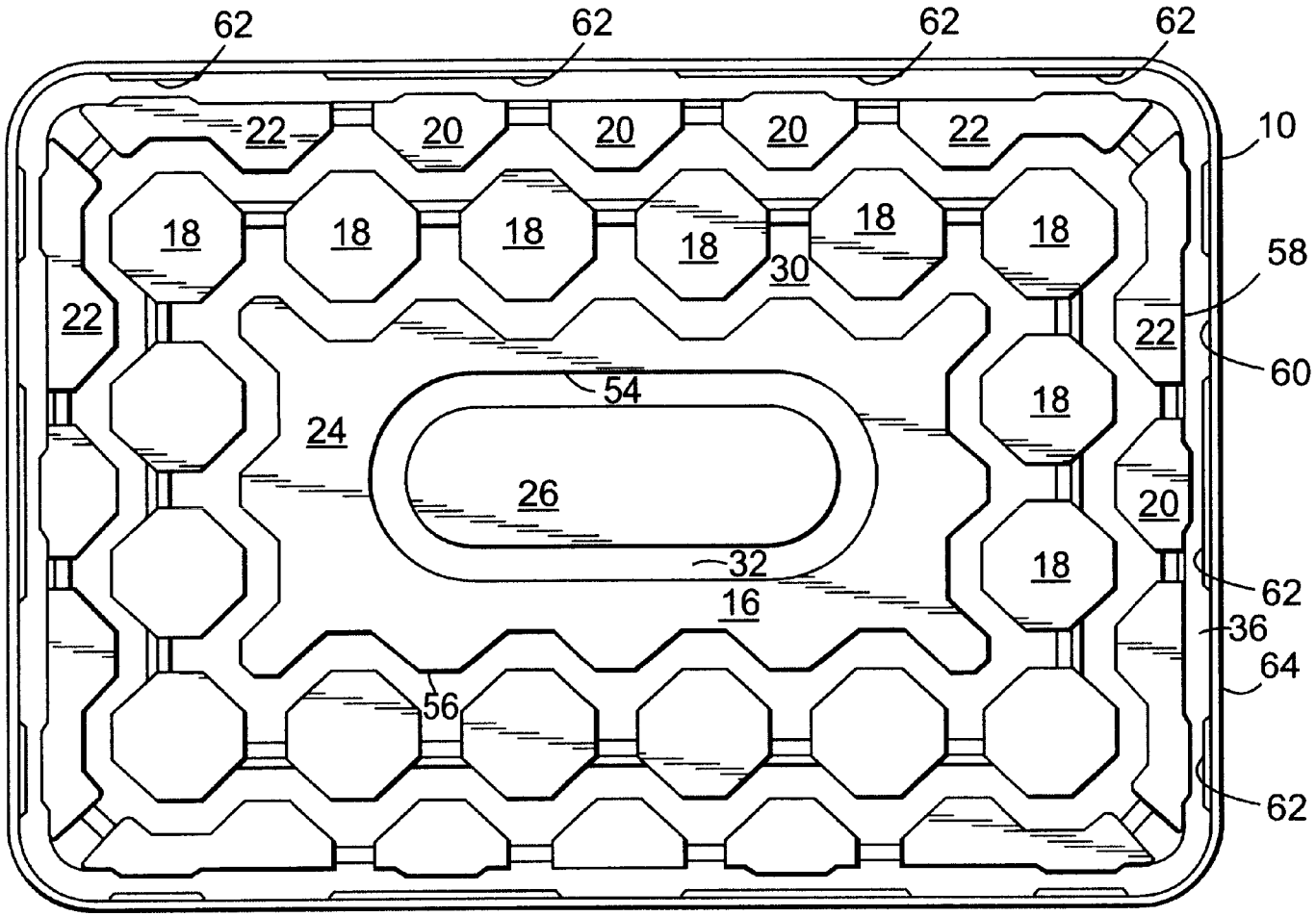
FIG. 2 is a top plan view of the base plate of the present invention.
Figure 3:
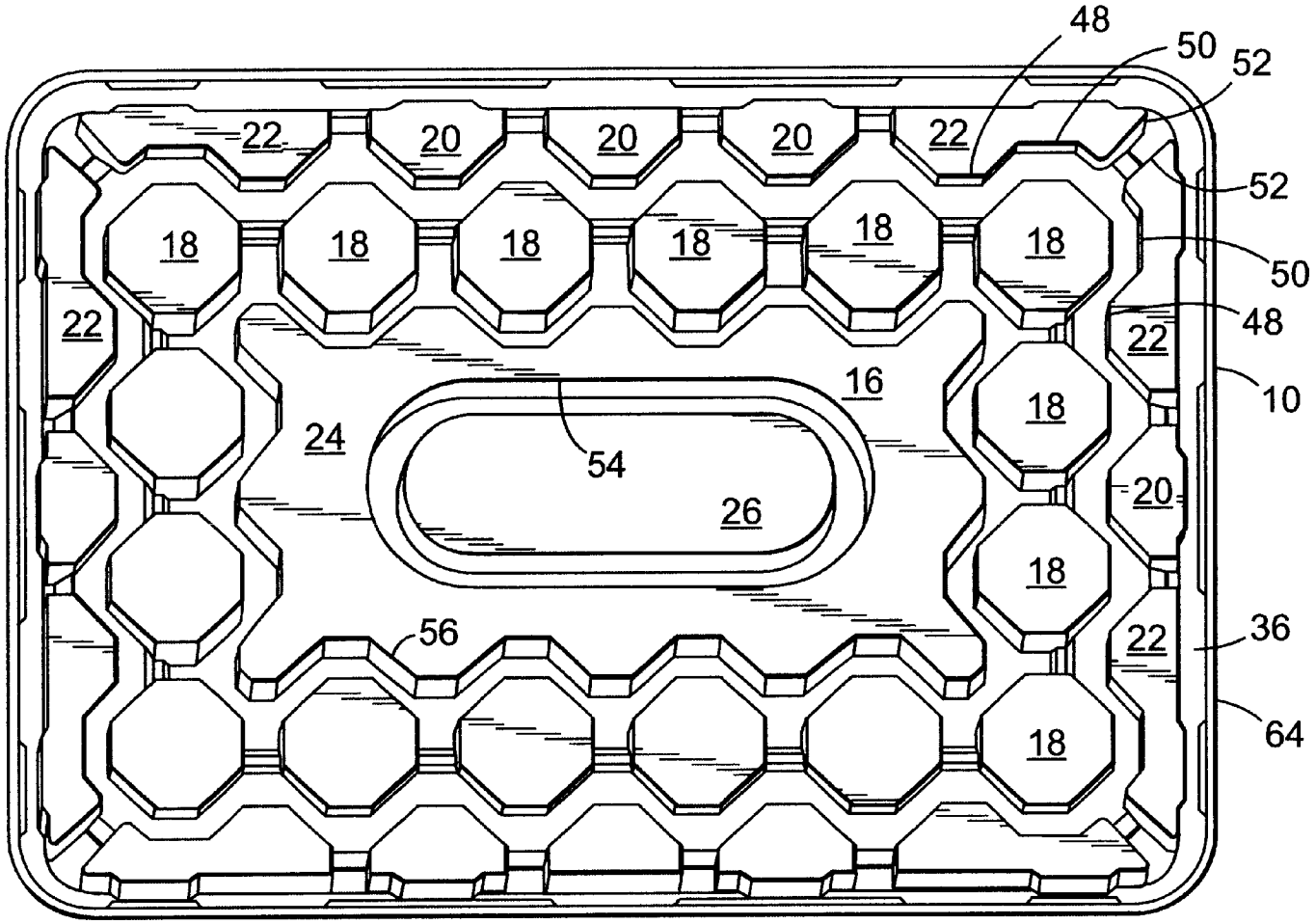
FIG. 3 is perspective view of the base plate of the present invention from above and to the left.

Referring now to the FIGURES, and most particularly to FIG. 1, a perspective view of a base plate 10 and a cover 12 forming a container 14 of the present invention may be seen. The base plate 10 is preferably formed from a sheet of polymer material or the like. Typically, the base plate 10 is opaque. The cover 12 is preferably formed of a clear polymer material or the like. Most preferably, the base plate 10 is formed of a thermoplastic polymer, such as polyester (e.g., polyester terephthalate or "PET") or polystyrene or polyethylene. The PET sheet is preferably formed in a thickness range of between about 0.015 and 0.025 inches, with most preferable thicknesses being 0.019 and 0.021 before forming, with the choice dependent upon the amount of strength desired in the finished part. The cover 14 is preferably formed of the same or a similar thermoplastic polymer.

Base plate 10 is intended to support bakery items such as sheet cakes. As such, it is most desirable that the upper surface of the base plate be generally planar and without projections above a top surface 16 of the base plate, to avoid interference with cutting and serving the cake. The base plate 10 of the present invention achieves this objective while providing a relatively rigid structure, also desirable in supporting a bakery item such as a sheet cake. Referring to FIGS. 1, 2, 3 and 5, the top surface 16 of base plate 10 is flat or planar. More particularly, top surface 16 is formed by lands or plateaus 18, 20, 22, 24, and 26. The lands are separated and preferably surrounded by stiffening projections 30, 32, and 34 which extend below the top surface 16 for increasing the rigidity of the base plate 10. Furthermore, a gutter 36 is preferably formed near the periphery of the base plate 10. Gutter 36 serves as receptacle for the lower peripheral edge 40 of cover 12 to retain cover 12 to base plate 10, and further provides stiffening of the base plate 10 and especially the container 14 when the cover 12 is assembled to the base plate 10.

Although the lands 18–26 are all desirably in the same plane, it is to be understood that the downwardly directed stiffening projections 30–34 may not all extend to the same depth. In the embodiment shown, stiffening projection 34 preferably extends to a shallower depth than projections 30 and 32. Gutter 36 preferably extends to the same depth as projections 30 and 32.

Figure 4:
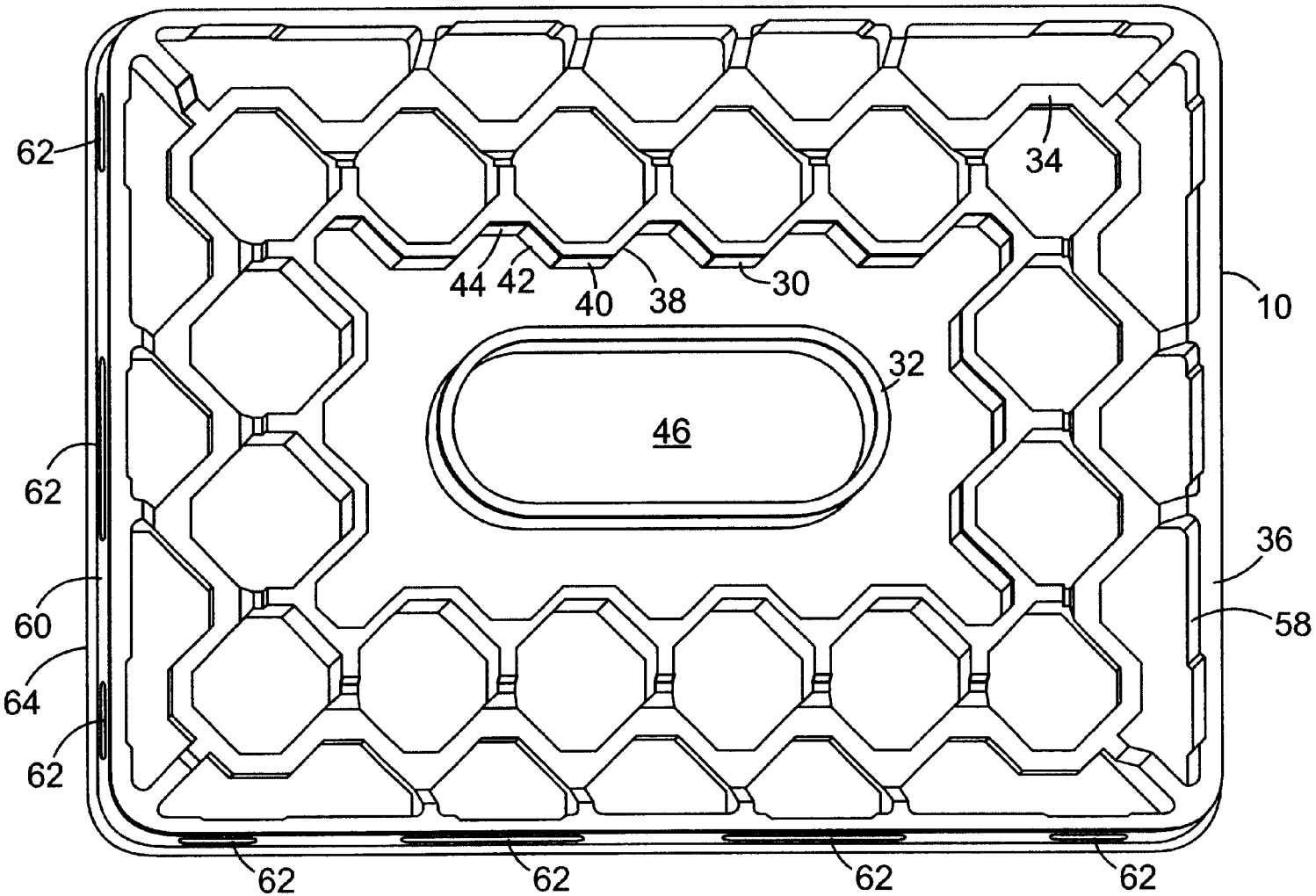
FIG. 4 is perspective view of the base plate of the present invention from below and to the left.
Figure 5:
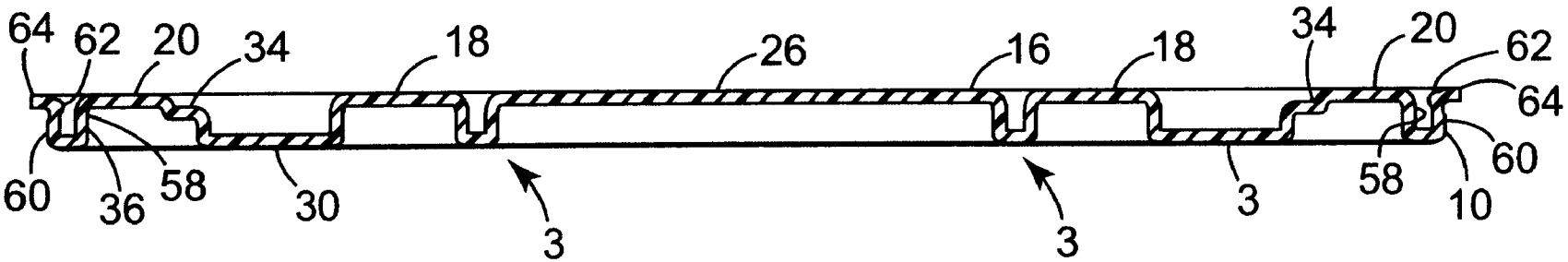
FIG. 5 is a section view of the base plate of the present invention taken along line 5—5 of FIG. 2.
Figure 6:
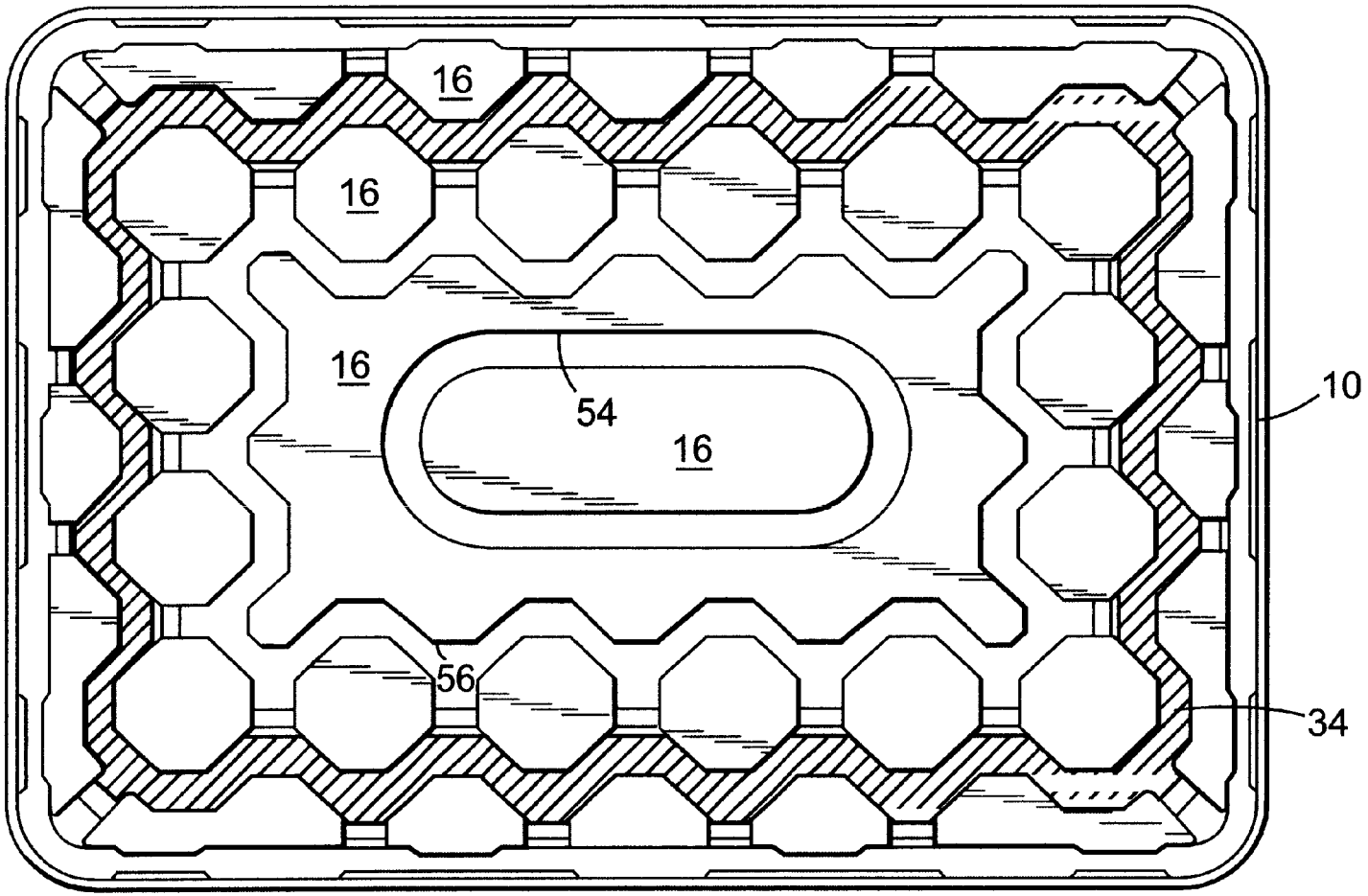
FIG. 6 is a top plan view of the base plate of the present invention showing a region of reduced depth projections with hatching to better illustrate a stacking feature of the present invention.

Projections 30 and 34 are non-linear, preferably serpentine or "zig-zag" shape in plan view, as may be seen most clearly in FIGS. 4 and 6. By "non-linear" it is meant that the pattern formed by the projections results in an absence of linear axes along which the base plate is more readily free to flex or bend, and in the extreme, to fold, resulting in substantially increased rigidity for the base plate.

In FIG. 6, the shallower projection 34 is hatched for clarity. Referring most particularly to FIG. 4, stiffening projection 30 is formed of a plurality of short linear segments 38, 40, and 42, in addition to Y-shaped segments 44.

Projection 32 is preferably an oval-shaped stiffening projection defining an oval-shaped land 26 and is located in a central region 46 of base plate 10. Projection 32 is free of interconnections with projections 30 and 34. By "free of interconnections" is meant that there is no projection or projection-like interconnection between the elements mentioned. It is to be understood that the elements are preferably formed of the same, continuous material of the sheet and in that sense are "connected." Projection 32 reduces the "sponginess" in the middle or central region 46.

Projections 30 and 34 together make up a peripheral stiffening projection pattern and taken together define each of the plurality of octagonal lands 18. Projection 34 and gutter 36 together define the lands 20 and 22. Land 20 corresponds to substantially half of an octagonal land 18. Land 22 is an irregular shape including a convex portion 48 and a concave portion 50 of an octagon, together with a mitered end 52.

Projections 30 and 32 together define land 24 which has a centrally located oval-shaped opening or recess 54 and a serpentine outer periphery 56. Outer periphery 56 partially defines the shape of projection 30.

Gutter 36 has an inner side wall 58 and an outer side wall 60. A majority of inner side wall 58 is defined by the outer sides of lands 20 and 22. The outer side wall 60 has a plurality of indentations 62 to retain the cover 12 to the base plate 10. Gutter 36 also preferably has an outer peripheral flange 64.

Figure 7:
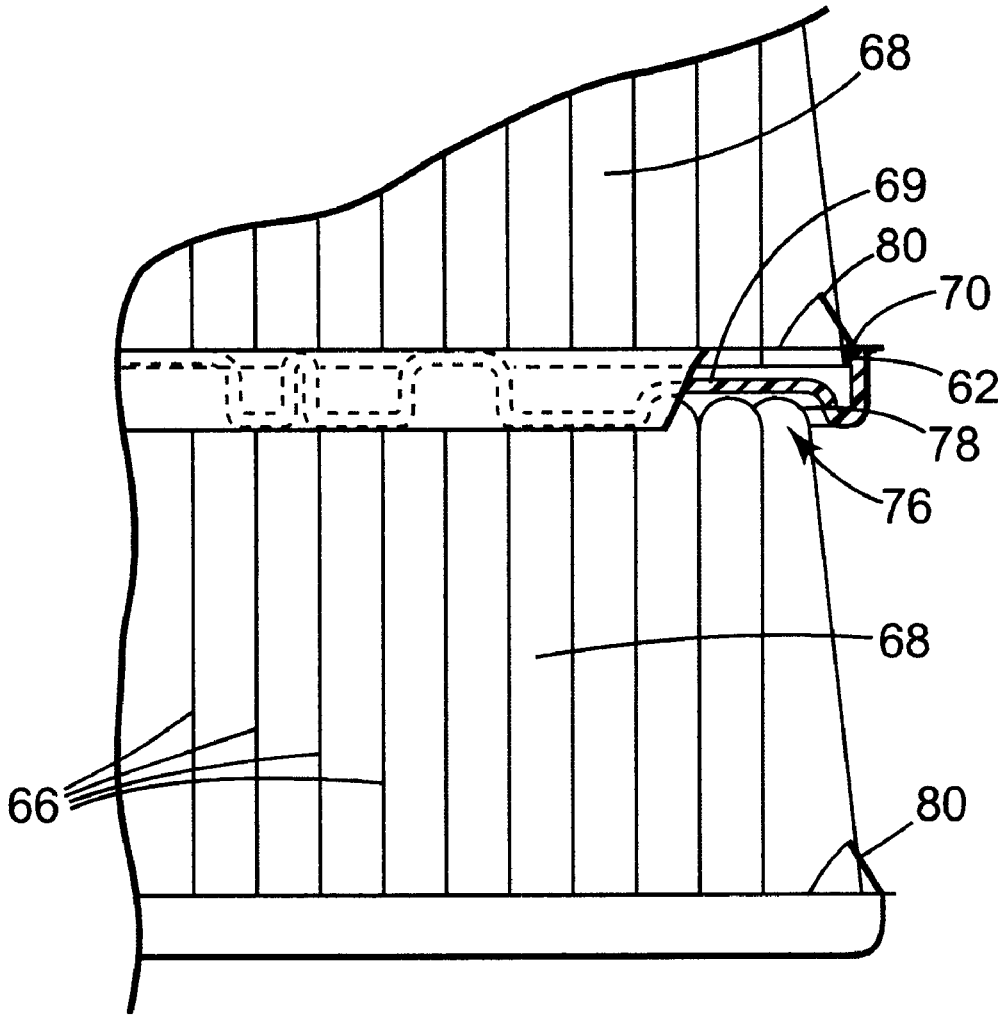
FIG. 7 is a fragmentary elevation view partially in section showing the stacking feature of the present invention.

Referring now to FIGS. 1 and 7, the cover 12 preferably has a plurality of ribs 66 formed in each side wall 68. Cover 12 has a depending peripheral flange 70 at a lower edge 69 of each side wall 68. When cover 12 is assembled to base plate 10, lower edge 69 is received in gutter 36, and flange 70 is retained by indentations 62. Cover 12 also has a generally planar top surface 72 located interiorly of a frame or border rib 74. Ribs extend up side walls 68 and form a slightly raised or elevated peripheral region 76 at an upper edge 78 of the top of cover 12. Cover 12 also preferably has a conic portion 80 formed at each lower corner of cover 12 for rigidity and ease of assembly of the cover 12 to the base plate 10.

A method of stiffening the base plate 10 for the bakery container 14 includes forming the polymer sheet of the base plate 10 to have the generally planar top surface 16 free of projections above the top surface 16, and forming the plurality of non-linear stiffening projections in the sheet which extend below the top surface 16 for increasing the rigidity of the base plate 10. In forming the plurality of projections, it is preferable to include forming the oval shaped projection 32 in the central region 46 of the sheet for stiffening the central region 46 of the sheet. The method also includes forming the gutter 36 to have a first depth about the periphery of the sheet or base plate 10, and to form at least one stiffening projection 34 having a depth less than the first depth. It is to be understood that at least one stiffening projection (30) is serpentine and has a depth equal to the first depth. The method of forming the base plate also includes forming a plurality of lands between the serpentine projections and also includes forming the serpentine projections from a plurality of non-aligned linear segments 38, 40, and 42.

The invention is not to be taken as limited to all of the details thereof as modifications and variations thereof may be made without departing from the spirit or scope of the invention. For example, and not by way of limitation, the serpentine shape may be sinuous or sinusoidal. Furthermore, the stiffening projections may extend upward to define a planar surface on which the food item is supported.

Accordingly, what is claimed is:

1. A food container comprising:

a) a base plate formed from a polymer sheet and having:
   i) a generally planar surface, and
   ii) a plurality of stiffening projections extending out of the planar surface to increase the rigidity of the base plate wherein the plurality of stiffening projections include a peripheral pattern of non-linear projections and a central stiffening projection free of interconnection with the peripheral pattern of non-linear projections.

2. The food container of claim 1 wherein the base plate is free of projections above the planar surface.

3. The food container of claim 1 wherein the base plate further comprises a peripheral gutter below the planar surface.

4. The food container of claim 3 further comprising:

b) a cover having a depending peripheral flange formed to be congruent with the peripheral gutter of the base plate.

5. The food container of claim 1 wherein at least one of the stiffening projections of the polymer sheet further comprises a serpentine shape.

6. The food container of claim 5 wherein the serpentine shape is formed of linear segments.

7. The food container of claim 1 wherein the plurality of stiffening projections are at least partially separated by lands.

8. The food container of claim 7 wherein at least some of the lands are at least partially octagonally shaped.

9. The food container of claim 1 wherein the central stiffening projection is oval-shaped.

10. The food container of claim 9 further comprising an oval shaped land in the planar surface and within the oval shaped central stiffening projection.

11. The food container of claim 1 wherein the base plate has a peripheral gutter with a first depth and the plurality of stiffening projections includes at least one stiffening projection having a depth less than the first depth and located interior of and generally adjacent to the gutter.

12. The food container of claim 11 further comprising a cover having a generally planar top surface with a slightly raised peripheral region adapted to mate with the at least one stiffening projection interior of and adjacent to the gutter of a suprajacent base plate.

13. A method of stiffening a base plate for a food container comprising:

a) forming a polymer sheet to have a generally planar surface, b) forming a plurality of non-linear stiffening projections in a peripheral region of the sheet and extending out of the planar surface for increasing the rigidity of the base plate; and c) forming a central stiffening projection free of interconnection with the plurality of non-linear stiffening projections in the peripheral region of the sheet.

14. The method of claim 13 wherein step a) includes forming the polymer sheet to be free of projections above the planar surface.

15. The method of claim 13 wherein step c) further comprises:

forming the central stiffening projection as an oval in a central region of the sheet.

16. The method of claim 13 further comprising:

d) forming a gutter having a first depth about the periphery of the sheet.

17. The method of claim 16 wherein step d) further comprises forming a region of projections interior of the gutter and having a depth less than the first depth.

18. The method of claim 13 further including an additional step:

d) forming a peripheral gutter about the periphery of the sheet with a depth equal to a depth of the central stiffening projection.

19. The method of claim 18 wherein step b) further comprises:

forming a first serpentine projection in the sheet between the central stiffening projection and the gutter to stiffen the base plate.

20. The method of claim 19 wherein the first serpentine projection has a depth equal to the depth of the central stiffening projection.

21. The method of claim 20 wherein step b) further comprises:

forming a second serpentine projection in the sheet between the first segmented serpentine projection and the peripheral gutter and wherein the second segmented serpentine projection has a depth less than the depth of the first serpentine projection.

22. The method of claim 21 wherein step b) further comprises:

forming a plurality of lands between the first and second serpentine projections.

23. The method of claim 19 wherein the serpentine projection is formed from non-aligned linear segments.

24. A food container comprising:

a) a base plate having a food supporting surface with a central region, a peripheral region and a mediate region between the central region and the peripheral region;

b) a first serpentine stiffening member extending below the food supporting surface; and c) a central stiffening projection free of interconnection with the first serpentine stiffening member.

25. The food container of claim 24 wherein the first serpentine stiffening member is located in the mediate region.

26. The food container of claim 24 further comprising:

c) a second serpentine stiffening member located in the peripheral region.

27. The food container of claim 26 wherein the first stiffening member has a first depth and the second stiffening member has a second depth less than the first depth.

28. The food container of claim 26 wherein the first and second stiffening members together form a plurality of polygonal elements.

29. The food container of claim 28 wherein the polygonal elements are at least partially octagonal.

30. The food container of claim 28 wherein the central stiffening member surrounds an oval shaped land.

31. The food container of claim 24 wherein the central stiffening member further comprises an oval shape located in the central region.

32. A food container comprising a base plate having a) a plurality of discrete lands, each land having a top surface, the top surfaces of at least some of the lands located in a plane upon which a food item is supportable, and b) at least one serpentine depression extending below the plane of the top surface of the lands and at least partially separating the lands from each other, the serpentine depression adding stiffness to the base plate.

33. The food container of claim 32 wherein the lands further comprise a plurality of polygonal elements.

34. A food container comprising a base plate including:

a) a plurality of discrete lands, each land having a top surface, the top surfaces of at least some of the lands located in a plane upon which a food item is supportable, and b) a plurality of projections extending above the top surface of the lands and at least partially separating the lands from each other.

35. A food container comprising a base plate including:

a) a plurality of discrete lands, each land having a top surface, the top surfaces of at least some of the lands located in a plane upon which a food item is supportable, and b) a plurality of projections extending below the top surface of the lands and at least partially separating the lands from each other, and c) a central projection free of interconnection with the plurality of discrete lands.

36. The food container of claim 1 wherein the planar surface comprises a plurality of discrete lands at least partially separated from each other by the stiffening projections.

* * * * *

UNITED STATES PATENT AND TRADEMARK OFFICE

CERTIFICATE OF CORRECTION

PATENT NO. : 6,513,675 B1
DATED : February 4, 2003
INVENTOR(S) : Dean R. Brown et al.

It is certified that error appears in the above-identified patent and that said Letters Patent is hereby corrected as shown below:

Title page,
Item [56], References Cited, please add the following after last U.S. PATENT DOCUMENT:

-- FOREIGN PATENT DOCUMENTS 0 420 429 A1 1991 Europe --

Signed and Sealed this

Ninth Day of September, 2003

JAMES E. ROGAN
*Director of the United States Patent and Trademark Office*